United States Patent [19]

Zaslawsky

[11] Patent Number: 4,881,213

[45] Date of Patent: Nov. 14, 1989

[54] WATCH MOVEMENT HAVING DATE AND PHASES OF THE MOON INDICATORS

[75] Inventor: Abraham Zaslawsky, Neuchâtel, Switzerland

[73] Assignee: Eta sa Fabriques d'Ebauches, Switzerland

[21] Appl. No.: 245,182

[22] Filed: Sep. 16, 1988

[30] Foreign Application Priority Data

Sep. 24, 1987 [CH] Switzerland ..... 03692/87

[51] Int. Cl.[4] ..... G04B 19/26

[52] U.S. Cl. ..... 368/15

[58] Field of Search ..... 368/15–20

[56] References Cited

U.S. PATENT DOCUMENTS

| | | | |
|---|---|---|---|
| 3,721,083 | 3/1973 | Tauch | 368/18 |
| 4,548,512 | 10/1985 | Erard | 368/15 |

FOREIGN PATENT DOCUMENTS

| | | | |
|---|---|---|---|
| 2567288 | 1/1986 | France | 368/15 |
| 60-60580 | 4/1985 | Japan | 368/15 |
| 13243 | 6/1912 | Switzerland . | |
| 534380 | 11/1978 | Switzerland . | |
| 604233 | 3/1983 | Switzerland . | |
| 651440 | 9/1985 | Switzerland . | |

OTHER PUBLICATIONS

"Les montres-calendrier modernes" by B. Humbert published in the "Journal suisse d'horlogerie", pp. 96 and 97, and FIG. 156.

*Primary Examiner*—Vit W. Miska

*Attorney, Agent, or Firm*—Pollock, Vande Sande & Priddy

[57] ABSTRACT

A watch movement has indicators for the date and the phases of the moon, these two indicators being automatically driven by the same intermediate revolving wheel member effecting one revolution every 24 hours, the one indicator by one tooth longer than the others and the other indicator by a pin which acts on a wheel having fifty-nine teeth integral with the indicator of the phases of the moon. A satisfactory engagement of the driving members in the corresponding teeth is ensured by a transverse displacement of the revolving wheel member resulting from the fact that a resilient arm of this revolving wheel member holds the edges thereof resting permanently against a fixed cylindrical stud having a flat surface.

7 Claims, 3 Drawing Sheets

WATCH MOVEMENT HAVING DATE AND PHASES OF THE MOON INDICATORS

FIELD OF THE INVENTION

The object of the invention is a watch movement comprising an indicator for the date provided with a toothed wheel having thirty-one teeth and an indicator for the phases of the moon integral with a wheel having fifty-nine teeth and an intermediate revolving wheel member driven in rotation by the watch movement at the rate of one revolution every twenty-four hours and which causes each of these indicators to advance by one step for each revolution.

DESCRIPTION OF THE PRIOR ART

Watch movements of this type have been known for a long time. An old Swiss patent (No. 13243) describes a mechanism comprising an intermediate wheel driven in rotation by an hour wheel carrying the hour hand at the rate of one revolution every twenty-four hours. This intermediate wheel is provided with two pins which, on each revolution, cause the advancement by one step of, respectively, one eccentric wheel having thirty-one teeth, to indicate the successive dates, and another, also eccentric, wheel having fifty-nine teeth to indicate the corresponding phases of the moon.

In order that the dates of the indicator integral with the eccentric wheel having thirty-one teeth can be read, the mechanism described in said prior patent can only be constructed in connection with the movement of a pocket watch.

A system of Vacheron and Constantin (presented in the paper "Les montres-calendrier modernes"["Modern calendar watches"] by B. Humbert published in 1953 in an issue of the "Journal suisse d'horlogerie"["Swiss Horological Journal"], pages 96 and 97, FIG. 156) is provided with an analogous mechanism in which the intermediate wheel is, however, rotated, not by the hour wheel itself, but by a pinion engaging therewith. For each revolution, this intermediate wheel on the one hand, advances the wheel having thirty-one teeth which is integral with the date indicator by one step by means of a pin and, on the other hand, the wheel having fifty-nine teeth, which is integral with the indicator of the phases of the moon by means of a finger. In this system, the wheel having thirty-one teeth is mounted in the centre of the watch movement, making it possible to fix thereto an indicator having the same diameter as the watch movement.

In view of the fineness of the teeth of the wheel having fifty-nine teeth, the adjustment of the revolving members of this mechanism must be effected with particular care. The slightest wrong adjustment in one direction would have the result that the finger actuating the wheel having fifty-nine teeth would not displace this wheel sufficiently to cause the jumper cooperating therewith to engage with the following tooth space and, in the opposite direction, that the finger in question would be in danger of engaging two teeth simultaneously during the same passage or could engage with the base of the teeth of the wheel having fifty-nine teeth. This problem is particularly acute in wrist watches which have smaller dimensions than pocket watches.

Furthermore, a date mechanism is already known having means which, in the course of a predetermined angle of rotation of an intermediate revolving wheel member, displaces this latter in the direction of the date indicator. Mechanisms of this type are described in Swiss patents Nos. 651440 and 604233. The mechanism forming the object of the latter patent also comprises an indicator of the day of the week as well as means for driving this indicator. In this mechanism, the date and day indicators are driven simultaneously.

OBJECTS OF THE INVENTION

It is an object of the invention to provide a watch movement of the type indicated above of smaller dimensions than those of known watch movements, the functioning of which is nevertheless ensured, in particular without reducing the tolerances beyond conventional limits.

BRIEF SUMMARY OF THE INVENTION

The present invention thus provides a watch movement having indicators for the date and the phases of the moon, the date indicator having thirty-one teeth and that of the phases of the moon being integral with a wheel having fifty-nine teeth, an intermediate revolving wheel member driven in rotation by the watch movement at the rate of one revolution every twenty-four hours causing these indicators to advance by one step for each revolution, whereby at a predetermined angle of rotation of said intermediate revolving wheel member said wheel member is displaced in the direction of the teeth of the date indicator and whereby, at another predetermined angle of rotation of said intermediate revolving wheel member said wheel member is displaced in the direction of the wheel having fifty-nine teeth.

In a preferred embodiment of the invention the displacements of the intermediate wheel member are advantageously used to drive the date and lunar indicators referred to.

In a further preferred embodiment of the invention the members preferably used for driving these date and lunar indicators are an elongated tooth and a pin respectively, thereby considerably simplifying the manufacture of the intermediate revolving wheel member.

In a further embodiment of the invention the most advantageous direction for the displacement of this intermediate revolving wheel member is given as the plane between the axes of rotation of the two indicators.

In a further preferred embodiment of the invention a simple construction of the phases of the moon is given which avoids the need for a push button control extending outside the watch case.

BRIEF DESCRIPTION OF THE DRAWINGS

An embodiment of the watch movement of the invention is represented schematically and for purposes of example only in the drawing in which.

DETAILED DESCRIPTION OF THE INVENTION

Figure 1:
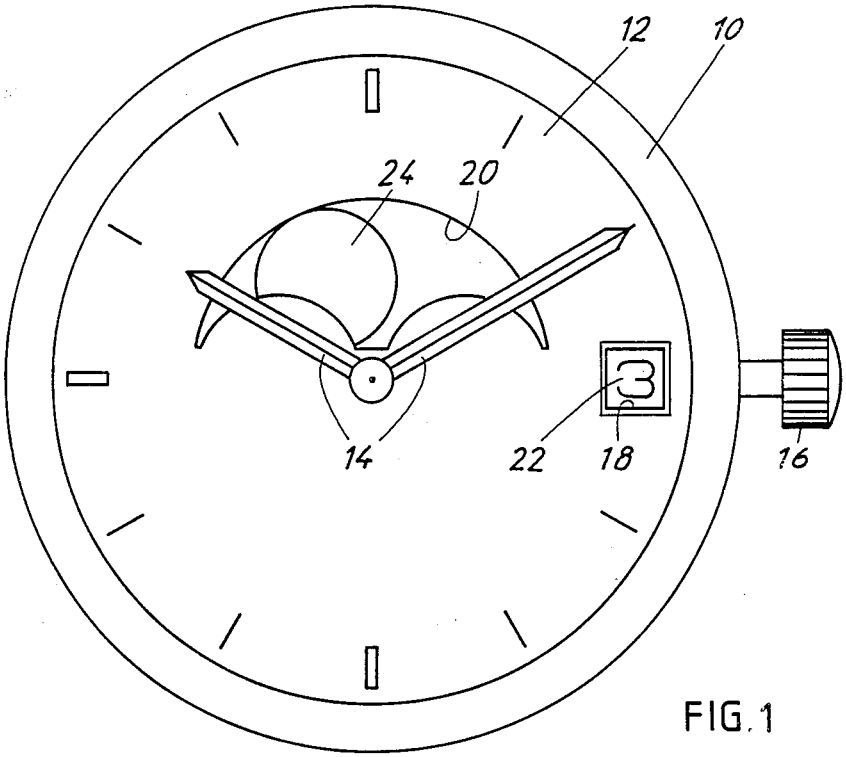
FIGS. 1 and 2 are planar views of a watch movement according to the invention with and without a dial respectively and FIGS. 3 and 4 respectively represent planar and sectional views of the drive mechanism of the indicators of the time and of the phases of the moon.

FIG. 1 shows a watch movement with a bottom plate 10, a dial 12, hands 14 and a crown for setting the time 16. The dial 12 has windows 18 and 20 through which appear respectively the date indicators 22 and the phases of the moon indicator 24.

Figure 2:
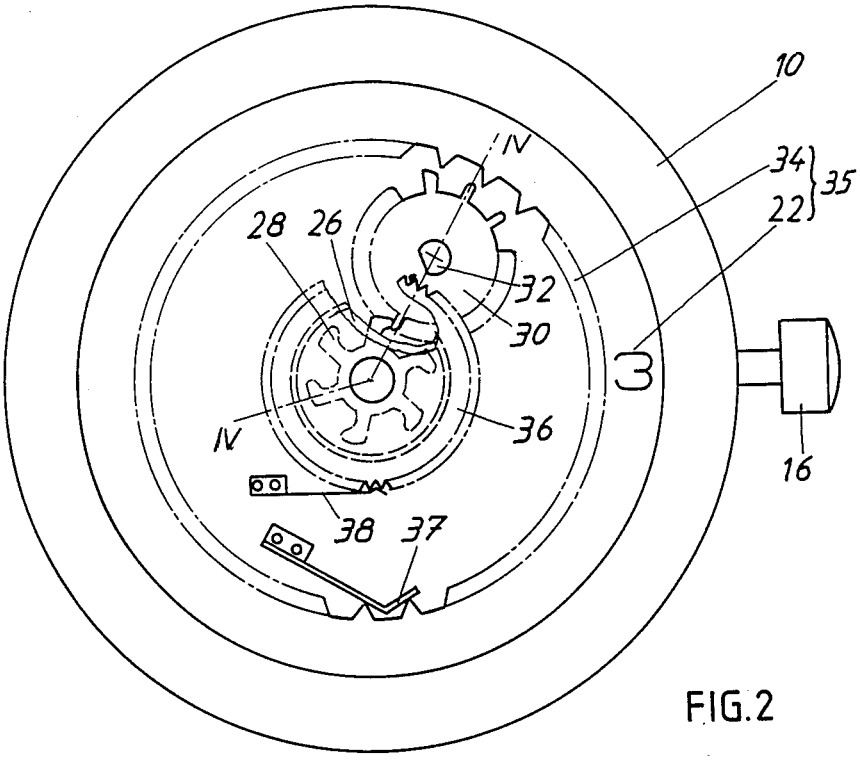
Figure 4:
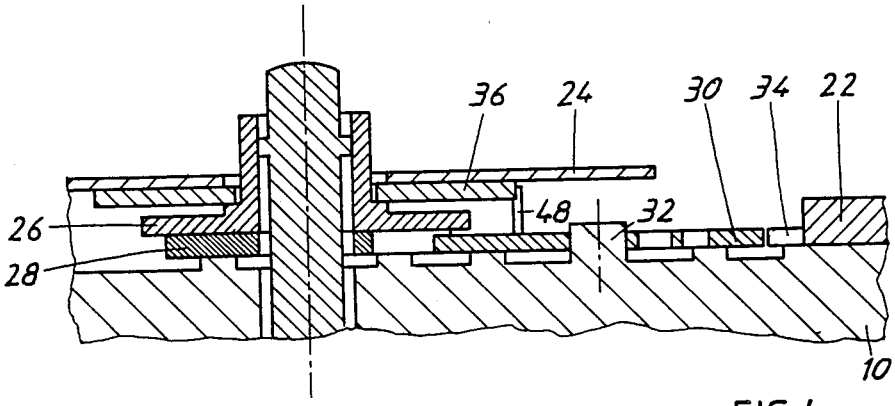

In FIG. 2 the dial and the indicator of the phases of the moon have been removed to make it possible to see the drive mechanism of the indicators. In the centre of the movement there is an hour wheel 26 which bears the hour hand as well as a wheel having six teeth 28. This wheel 28 meshes with an intermediate revolving wheel member 30 schematically represented and pivoting about a stud 32 fixed to the bottom plate 10. The date indicator 22 is integral with a toothed wheel 34 having thirty-one teeth which together form a ring 35. The ring 35 is pivotally mounted on the bottom plate 10 at it periphery and coaxially with the hands. The indicator of the phases of the moon 24 is fixed to a wheel 36 having fifty-nine teeth and pivotally mounted on the hour wheel 26. The toothed wheel 34 and the wheel 36 are driven by the revolving wheel member 30, by means which will be explained with reference to FIGS. 3 and 4. The indicators 22 and 24 are positioned by jumper springs 37 and 38 which cooperate respectively with the toothed wheel 34 and the teeth of the wheel 36.

Figure 3:
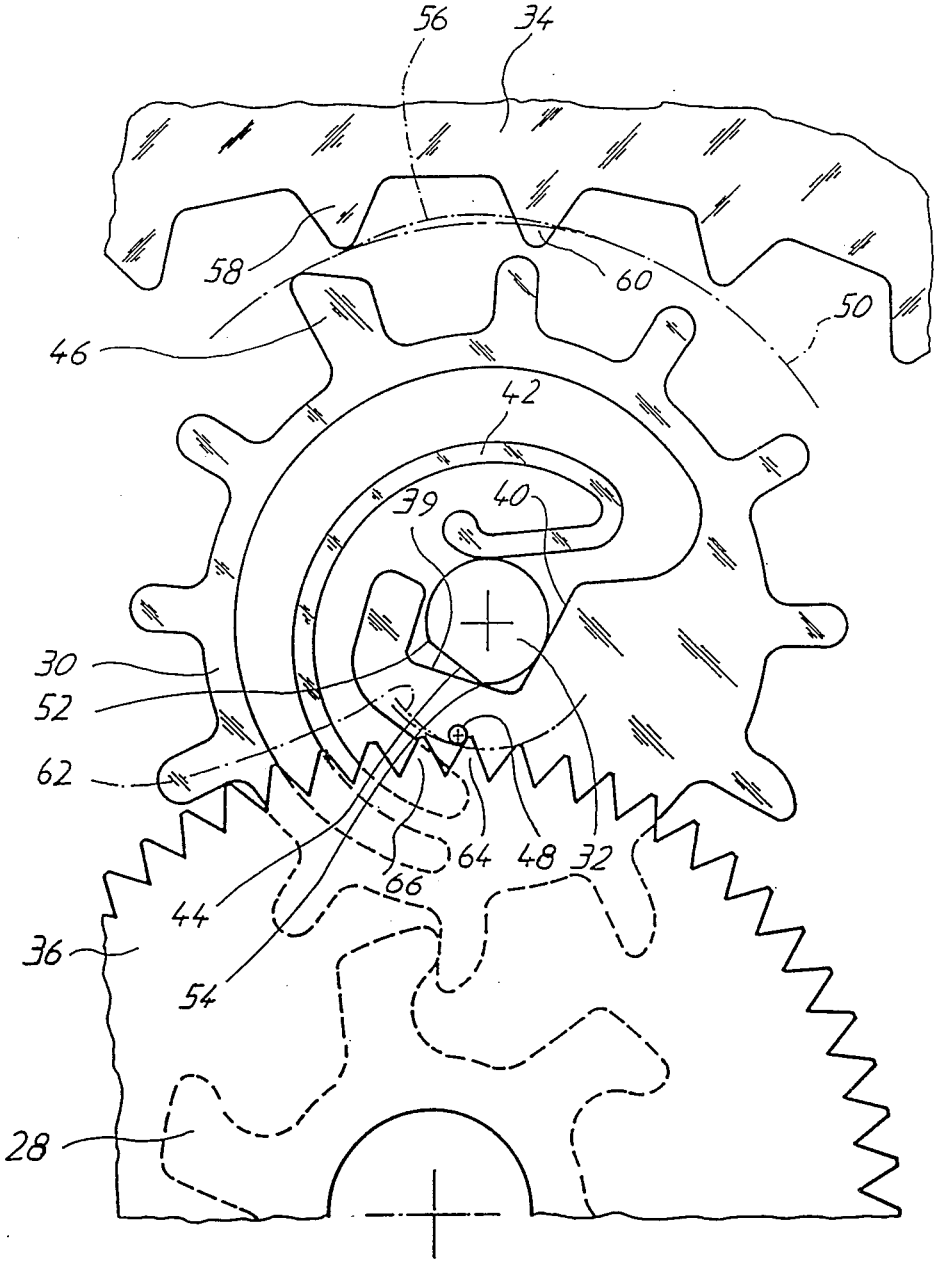

As may be seen from FIG. 3, the revolving wheel member 30 has twelve teeth and thus effects one revolution every twenty-four hours. This revolving wheel member 30 has a cut-out which defines two planar cam surfaces 39, 40 and a resilient arm 42. In all the angular positions of the revolving wheel member 30 the arm 42 holds the cam surfaces 39, 40 so that they press against the fixed cylindrical stud 32 which has a flat surface 44.

This revolving wheel member 30 has a first drive organ which is composed of one tooth 46 which is longer than the others and has a special profile. At each revolution of the revolving wheel member 30 the tooth 46 engages one tooth of the toothed wheel 34 of which only one part is shown in FIG. 3. At each passage the tooth 46 causes the toothed wheel 34 to advance by one step in the manner described below.

The wheel 30 also has a pin 48 which constitutes a second drive organ. At each revolution of the wheel 30 the pin 48 engages one tooth of the wheel having fifty-nine teeth 36 and causes it to advance by one step. Since the synodical revolution of the moon lasts about twenty-nine and a half days, i.e. the duration between two successive conjunctions with the sun, the wheel 36 effects one revolution in approximately two lunar periods.

If the stud 32 were perfectly cylindrical the extremity of the tooth 46 would pass along the arc of the circle 50. Before arriving at the configuration shown in the drawing, the flat surface of the cam 39 has, however, begun to pivot about the edge 52 of the stud 32 until this surface of the cam 39 lies flat against the flat surface 44 since it has been following its movement by pivoting about the edge 54 of the stud 32. At the angle of rotation described by the revolving wheel member 30, the latter is naturally displaced in the direction of the annular member 35. The point of the tooth 46 thus follows the curve 56. In other words, the tooth 46 penetrates more deeply into the teeth of the annular member 35 than it would if the intermediate revolving wheel member 30 were to mesh with an axis pivoted in fixed bearings, as was the case in known watch movements. In this manner, the driving of the annular member 35 is assured, even if the watch movement is of very small dimensions.

During the described travel, the tooth 46 enters into contact with the tooth 58 of the annular member 35 which then occupies the position of the tooth 60 and carries this tooth 58 with it until the edge of the jumper 37 has passed beyond one tooth of the annular member 35. At this moment the jumper 37 suddenly completes the advance of the annular member 35 until such time as it engages in the following tooth space of the teeth of the annular member 35.

Whilst the surface of the cam 39 pivots about the edge 54 of the stud 32, the revolving wheel member 30 progressively moves away from the annular member 35 and approaches the wheel 36. During this angle of rotation of the revolving wheel member 30, the pin 48 follows the arc of the curve 62 whilst engaging in the teeth of the wheel 36.

The position shown in the drawing is that in which the pin 48 has just entered into contact with the tooth 64 of the wheel 36. In following its rotation, the revolving wheel member 30 will drive the tooth 64 with the aid of the pin 48 sufficiently far to make the jumper 38 cooperating with the wheel 36 pass into the following tooth space, suddenly completing the advance of this wheel 36.

It will be noted that, due to a special movement of the revolving wheel member it is possible to increase the certainty of engagement between the pin 48 and the tooth following the tooth 64 in comparison to the security of engagement which would be achieved using a revolving wheel member pivoting in a fixed bearing.

By actuating the hour-setting crown so as to turn the hands in an anticlockwise direction, the pin 48 enters into contact with the tooth of the wheel 36 which occupies the position of the tooth 64. It thus drives the wheel 36 backwards, but not far enough to make the corresponding jumper engage in the preceding tooth space because the pin 48 follows the arc 62 in the opposite direction which moves it away from the wheel 36 and makes it emerge rapidly out of engagement with the teeth of this wheel. This arrangement permits the indicator of the phases of the moon to be set by simply making the hands of the watch turn successively backwards and forwards in such a way as to make the pin 48 pass first behind the tooth occupying the position of the tooth 64 without definitively changing the position of this tooth and then to drive this tooth to cause the wheel 36 to advance by one step.

To ensure this setting of the indicator of the phases of the moon under the best possible conditions it suffices to arrange the means which transversely displace the revolving wheel member 30 in such a way that the driving member of the wheel 36 begins to move closer to this wheel as soon as the other driving member has pushed the annular member 35 beyond the point of its jumper.

The annular member 35 can be set in a similar manner. Preferably, however, the movement of the watch will be equipped with a conventional mechanism which makes it possible to drive the annular member 35 about the watch movement by rotatably actuating the hour-setting crown previously pulled out into an intermediate axial position.

The actuation of the indicators described may be achieved in the same conditions of manufacture, assembly and security on a movement for a ladies' wrist watch. The same advantages are also achieved if the indicator of the phases of the moon is eccentric. The best results are obtained when the means producing the sideways movement of the intermediate revolving wheel member displace its axis of rotation at least approximately in the plane passing through the axes of rotation of the two indicators in question.

What is claimed is:

1. A watch movement having indicators for the date and the phases of the moon, the date indicator having thirty-one teeth and that of the phases of the moon being integral with a wheel having fifty-nine teeth, an intermediate revolving wheel member driven in rotation by the watch movement at the rate of one revolution every twenty-four hours causing these indicators to advance by one step for each revolution, whereby at a predetermined angle of rotation of said intermediate revolving wheel member said wheel member is displaced in the direction of the teeth of the date indicator and whereby, at another predetermined angle of rotation of said intermediate revolving wheel member said wheel member is displaced in the direction of the wheel having fifty-nine teeth.

2. A watch movement according to claim 1, wherein the said intermediate revolving wheel member has a first driving member which meshes with the teeth of the date indicator and causes it to advance by one step when said revolving wheel member is displaced in the direction of said teeth, and a second driving member which engages one tooth of the wheel having fifty-nine teeth to cause said wheel to advance by one step when the said revolving wheel member has been displaced in the direction of said wheel having fifty-nine teeth.

3. A watch movement according to claim 2 in which the said intermediate revolving wheel member is a toothed wheel, whereby the said first driving member of this toothed wheel has one tooth longer than the others and in that the said second driving member is a pin set in the said toothed wheel.

4. A watch movement according to claim 2, wherein the axis of said intermediate revolving wheel member is displaced in a plane passing between the axes of rotation of the date indicator and of the wheel having fifty-nine teeth.

5. A watch movement according to claim 3, wherein said intermediate revolving wheel member is driven in rotation by a toothed wheel meshing onto the hour wheel, wherein the wheel having fifty-nine teeth and the date indicator are coaxial with the hour wheel.

6. A watch movement according to claim 2, wherein displacement of the second of said driving members in the direction of the wheel having fifty-nine teeth commences immediately after the first of said driving members has pushed the date indicator beyond the point of the jumper which immobilizes it in its rest position.

7. A watch movement having a date indicator mounted on a toothed wheel having thirty-one teeth, an indicator for the phases of the moon mounted on a toothed wheel having fifty-nine teeth, an intermediate revolving wheel member, said intermediate revolving wheel member being driven by a watch movement so as to rotate once every twenty-four hours, drive means which at a predetermined angle during rotation connect said intermediate revolving wheel member to said toothed wheels having thirty-one and fifty-nine teeth respectively, whereby for each single revolution of said intermediate wheel member said drive means cause said toothed wheels having thirty-one and fifty-nine teeth respectively each to advance in rotation by the space of one tooth and first displacing means to move said intermediate wheel member towards said wheel having thirty-one teeth at a first predetermined angle of rotation and second displacing means to move said intermediate wheel member towards said wheel having thirty-one teeth at a second predetermined angle of rotation.

* * * * *